United States Patent [19]

Wilkinson

[11] 4,060,266

[45] Nov. 29, 1977

[54] SURFACE BOLT

[75] Inventor: Eric Wilkinson, Woodbridge, Conn.

[73] Assignee: Leigh Products, Inc., Coopersville, Mich.

[21] Appl. No.: 691,415

[22] Filed: June 1, 1976

[51] Int. Cl.[2] ..... E05C 1/04

[52] U.S. Cl. ..... 292/148; 70/129

[58] Field of Search ..... 292/67, 104, 145–154, 292/162, 175, 189, 205, 207, 208; 70/129, 134, DIG. 6

[56] References Cited

U.S. PATENT DOCUMENTS

| | | | |
|---|---|---|---|
| 1,326,554 | 12/1919 | Watson | 292/205 X |
| 2,612,221 | 9/1952 | Dellapent | 292/148 X |
| 2,620,213 | 12/1952 | Keeler | 292/147 |
| 3,374,020 | 3/1968 | Berg | 292/148 X |
| 3,451,703 | 6/1969 | Roegner | 70/129 X |
| 3,695,657 | 10/1972 | Rosen | 292/148 X |
| 3,752,518 | 8/1973 | Cannell | 292/148 X |

FOREIGN PATENT DOCUMENTS

| | | | |
|---|---|---|---|
| 853,639 | 12/1939 | France | 292/148 |
| 159,111 | 6/1957 | Sweden | 292/148 |
| 237,939 | 6/1945 | Switzerland | 292/67 |
| 405,845 | 2/1934 | United Kingdom | 292/153 |

*Primary Examiner*—Roy D. Frazier
*Assistant Examiner*—William E. Lyddane
*Attorney, Agent, or Firm*—DeLio and Montgomery

[57] ABSTRACT

A surface bolt adapted to be mounted on an inner or outer surface of a closure member, such as a door or window, the bolt being slidable in guides between positions into and out of engagement with a keeper. One of the guides is provided with means to receive the bow of a padlock in two positions, in one position to prevent unlocking of the bolt or, in the other position to prevent locking of the bolt. The bolt may have a recess extending across its outer surface, positioned and dimensioned to be engaged by one of the guides in the locking position of the bolt and to be resiliently and releasably held in such engaged position by a spring.

3 Claims, 4 Drawing Figures

SURFACE BOLT

This invention relates to a surface bolt adapted to be mounted on a closure member, such as a door or window, the bolt being slidable in guides between positions into and out of engagement with a keeper or the like, the bolt being plain or having, optionally, a recess on its outer surface adapted to be engaged by one of the guides in the locking position of the bolt and to be resiliently and releasably held in such engaged position by a spring. One of the guides is provided with means to receive the bow of a padlock in positions either to prevent unlocking of the bolt or to prevent locking of the bolt.

The present device is an improvement over similar bolts, operating similarly, but without any comparable means for locking the bolt selectively in locked or unlocked position.

In a typical surface bolt having a rectangular cross-section, a retaining recess in its surface and a leaf spring, two spaced guides and a combined spring mounting and bolt stop are carried on the surface of an elongated base plate, having holes near each end for securement to the closure element, such as a door. A stop for limiting the retraction movement is provided near the end, beyond the rear guide. The only means for retaining the bolt in locked position is the retaining recess which engages one of the guides, but can be forced out of such engagement, and thus is no means at all for holding the bolt in unlocked position. A simpler form of surface bolt is a cylindrical bar, slidable in circular guides, and adapted to be retained in limit positions by the engagement of the operating knob system in notches at each end of an elongated slot in the guide housing.

It is an object of the present invention to provide a bolt having a rectangular cross-section, wherein one guide has an extension adapted to receive the bow of a padlock in either of two positions to hold the bolt in locking position or, alternatively, to hold the bolt in unlocked position, as desired.

It is yet another object of the invention to provide certain improvements in the form, construction and arrangement of the several parts whereby the above named and other objects may effectively be attained.

The invention accordingly comprises an article of manufacture possessing the features, properties, and the relation of elements which will be examplified in the article hereinafter described, and the scope of the invention will be indicated in the claims.

A practical embodiment of the invention is shown in the accompanying drawings, wherein.

Figure 1:
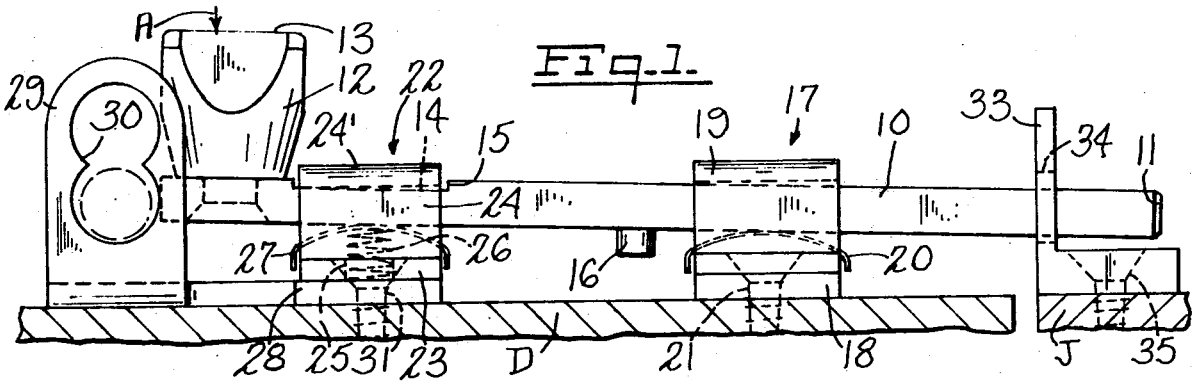
FIG. 1 is a plan view of the bolt mounted on the surface of a door and engaged with a keeper on an adjacent surface, such as the door jamb.

Referring to the drawings the bolt 10 is a bar having a somewhat flat rectangular cross-section, its forward end 11 being preferably beveled along each edge, and its rearward end portion having mounted thereon an operating knob 12 with a flat top surface 13. Adjacent the knob, the surface of the bolt is, optionally, provided with a transverse recess 14, at least the forward wall 15 of which lies at a right angle to the longitudinal axis of the bolt. A stop 16 is mounted on the under side of the bolt.

A first guide 17 comprises a base 18, which may be laminated, and a staple portion 19, so dimensioned as to permit free sliding movement of the bolt therethrough with additional space to accommodate an arcuately profiled saddle 20, the center of which bears resiliently against the under surface of the bolt. The base of the guide is bored near each end to receive the mounting screws (or bolts) 21 for attaching the guide to a surface, as near one edge of a door D.

A second guide 22 comprises a base 23 and a staple portion 24, similar to the staple portion 19, the base being centrally bored at 25 and in the form shown, provided with a coil spring 26 under compression, biasing a saddle 27 toward the under surface of the bolt. The spring could, if desired, be constituted by a body of compressible material.

Figure 3:
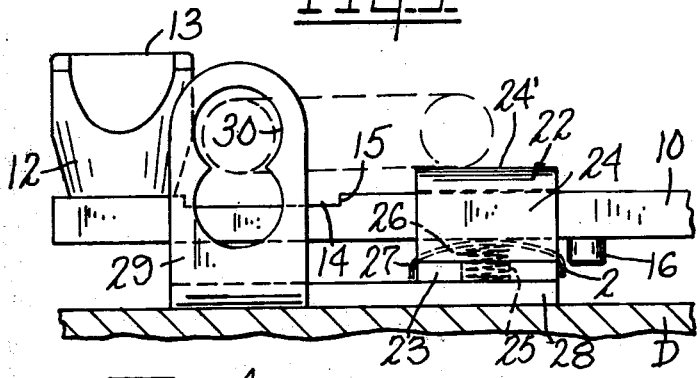
FIG. 3 is a detail plan view corresponding to the left end of FIG. 1 with the bolt in unlatched position.

The base 23 corresponds to the upper lamination of base 18; the lower lamination being replaced by a lock plate 28, extending under the guide and rearwardly therefrom, the plate having a pair of upturned ears 29 with figure- 8 shaped holes 30 having upper and lower lobes to receive the bow of a padlock in either of two positions, as shown in broken lines in FIGS. 1 and 3, or other retraction-arresting device such as a pin or bar. The base 23 and plate 28 are bored near each end of the base to receive mounting screws (or bolts) 31.

The bolt set is completed by the provision of a keeper 33, having an opening 34 sized to receive freely the forward end of the bolt and adapted to be mounted on a support, such as a door jamb J, by means of screws (or bolts) 35.

Figure 2:
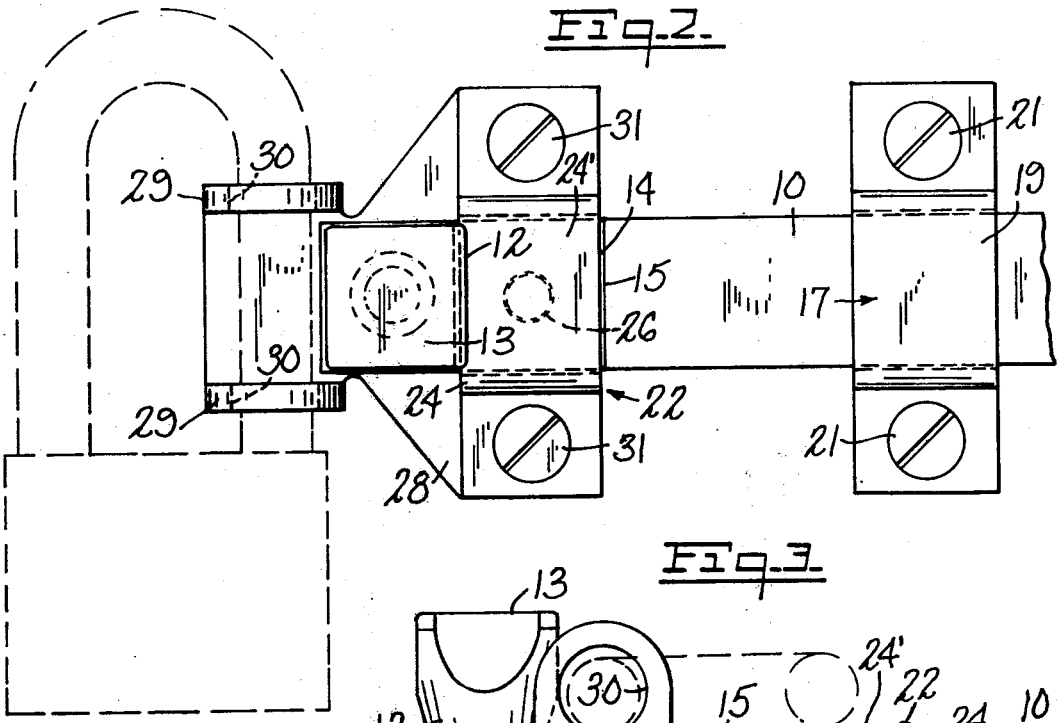
FIG. 2 is an elevation of the bolt as in FIG. 1, but omitting the keeper and jamb.

The recess 14, when present, has a dimension, lengthwise of the bolt, such that it can receive freely the top run 24' of the staple 24, as shown in FIGS. 1 and 2, the bolt being urged into that position by the spring 26. When so latched, the wall 15 will catch against the edge of the guide, and the bolt will not accidentally retract. It is difficult, but not impossible to release the bolt from outside (i.e., from below FIG. 1), and the addition of a padlock materially increases the security. In order to free the bolt, in normal operation, pressure is applied in the direction of the arrow A in FIG. 1, overcoming the bias of the spring 26, and the bolt can then be retracted as shown in FIG. 3. In the absence of a recess 14, the plain bolt could be freely moved between locked and unlocked positions.

The respective guides should be so located that the stop 16 will hit the saddle 27 (as in FIG. 3) before the forward end of the bolt is drawn out of the guide 17 but after the bolt end has cleared the keeper 33. The ears 29 and holes 30 are so positioned that a padlock bow (shown in broken lines) passing therethrough will prevent retraction of the bolt out of the keeper. This is true whether the bow is in the upper or lower portions (lobes) of the holes 30, but the greatest security is attained by using the lower portion, as in FIGS. 1 and 2, so that the padlock bow will be adjacent the end of the bolt and constitute a positive barrier against any movement thereof. If passed through the upper portions of the holes, the bow would act only against the side of the knob 12 which might, for any reason, become loose or broken off so that the bolt could be retracted through the space beneath the bow.

Figure 4:
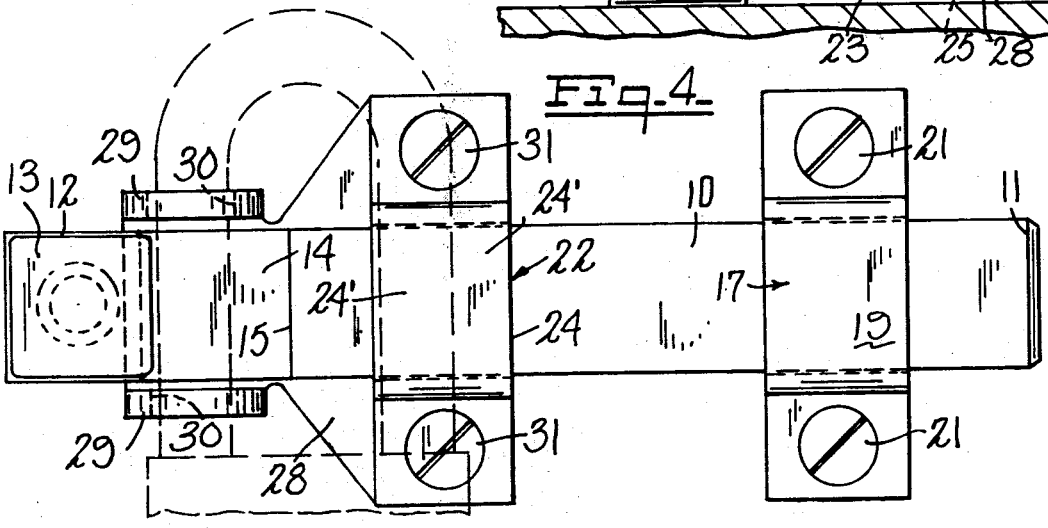
FIG. 4 is an elevation similar to FIG. 2, with the bolt in the position of FIG. 3.

It may frequently be important or desirable to provide means to prevent the bolt from being moved, accidentally, inadvertently or mischievously, from unlocked position to locked position, and such means is provided herein by the upper portion of the holes, as shown in FIGS. 3 and 4.

In these figures the bolt is shown in retracted (unlocked) position, with the knob 12 entirely rearward of the line of the holes 30 and a padlock bow (broken lines) passing through the upper portions of the holes, above the bolt and in a position to stop forward movement of the knob. In this position the bolt cannot be subjected to strong closing forces (except by a blow against its rear end) so that the retention of the knob, as described, securely prevents undesired locking of the bolt.

While the holes 30 are shown and described as being "figure- 8 shaped" in order to have definitive upper and lower portions, it will be understood that the proportions of the elements involved may be such that each said portion can be constituted by a separate hole, closely adjacent one another.

Apart from the mechanical advantages of the structure described, the location of the stop 16 between the guides and the spring 26 within a guide, both out of sight, enhances the appearance of the assembly and makes for a very neat design.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What is claimed is:

1. A surface bolt assembly comprising, an elongated bolt body having top and bottom surfaces and forward and rearward ends, forward and rearward guides for said body, the body being slidable longitudinally in said guides between locked and unlocked positions, a knob projecting from said top surface adjacent the rearward end of the bolt, and means adjacent the rearward guide adapted to receive a bolt stopping member, said means being constituted by projecting elements disposed on opposite sides of the path of movement of the bolt and knob, said elements having holes aligned to receive said bolt stopping member in either of two positions, wherein in a first of said positions said bolt stopping member is engagable with said bolt to prevent movement thereof in one direction, and in a second of said positions said bolt stopping member is engagable with said knob to prevent movement thereof in the opposite direction.

2. A surface bolt assembly according to claim 1 wherein a lock plate extends rearwardly from the rearward guide, said projecting elements being integral with said lock plate.

3. A surface bolt assembly according to claim 1 wherein the holes are substantially figure- 8 shaped, with upper and lower lobes, the lower lobes being aligned with the path of travel of the bolt end to define said first position, and the upper lobes being aligned with the path of travel of the knob to define said second position.

* * * * *